US010119441B2

(12) United States Patent
Chang et al.

(10) Patent No.: US 10,119,441 B2
(45) Date of Patent: Nov. 6, 2018

(54) WASTE AIR EXHAUSTING DEVICE HAVING FUNCTIONALITY TO ABATE NOISE AND MODULATE NOISE FREQUENCY

(71) Applicant: Chung Yuan Christian University, Taoyuan (TW)

(72) Inventors: Cheng-Yuan Chang, Taoyuan (TW); Sen-Maw Kuo, Taoyuan (TW)

(73) Assignee: Chung Yuan Christian University (TW)

( * ) Notice: Subject to any disclaimer, the term of this patent is extended or adjusted under 35 U.S.C. 154(b) by 199 days.

(21) Appl. No.: 15/230,006

(22) Filed: Aug. 5, 2016

(65) Prior Publication Data

US 2017/0268395 A1 Sep. 21, 2017

(30) Foreign Application Priority Data

Mar. 16, 2016 (TW) ..... 105108144 A

(51) Int. Cl.
*F01N 1/06* (2006.01)
*G10K 11/178* (2006.01)

(52) U.S. Cl.
CPC ..... *F01N 1/065* (2013.01); *G10K 11/1781* (2018.01); *G10K 11/17853* (2018.01); *G10K 11/17881* (2018.01); *G10K 11/178* (2013.01); *G10K 2210/12822* (2013.01); *G10K 2210/3012* (2013.01); *G10K 2210/3026* (2013.01); *G10K 2210/3027* (2013.01); *G10K 2210/3028* (2013.01); *G10K 2210/3055* (2013.01)

(58) Field of Classification Search
CPC combination set(s) only.
See application file for complete search history.

(56) References Cited

U.S. PATENT DOCUMENTS 5,022,082 A * 6/1991 Eriksson ..... G10K 11/178 381/71.8
5,097,923 A * 3/1992 Ziegler ..... F01N 1/065 181/206

(Continued)

FOREIGN PATENT DOCUMENTS

JP WO 2015133094 A1 * 9/2015 ..... F24F 13/24
WO WO 2015124211 A1 * 8/2015 ..... H04R 25/554

*Primary Examiner* — Duc Nguyen
*Assistant Examiner* — Assad Mohammed

(57) ABSTRACT

Differing from conventionally-used exhaust pipe utilizing discontinuous section area(s) and sound-absorbing material (s) to abate the noise produced by an engine, the present invention provides a waste air exhausting device consisting of: a housing, a supporting plate disposed in the housing, a miniature microphone disposed at the end of the housing, and a loudspeaker disposed on the supporting plate. Therefore, according to the noise produced by the engine, a noise controller system coupling to the miniature microphone and the loudspeaker is able to produce an anti-noise signal through the loudspeaker for abating the engine noise. On the other hand, the noise controller system can also produce an anti-noise signal having specific frequencies components according to the frequency of the engine noise and a reference signal, so as to modulate the frequency of the engine noise by broadcasting the anti-noise signal having the specific frequencies components in the housing through the loudspeaker.

21 Claims, 7 Drawing Sheets

(56) References Cited

U.S. PATENT DOCUMENTS

| | | | | |
|---|---|---|---|---|
| 5,233,137 | A * | 8/1993 | Geddes | F01N 1/065 181/206 |
| 5,432,857 | A * | 7/1995 | Geddes | F01N 1/065 381/71.7 |
| 5,457,749 | A * | 10/1995 | Cain | F01N 1/065 381/71.5 |
| 5,748,749 | A * | 5/1998 | Miller | F01N 1/023 381/71.5 |
| 6,185,627 | B1 * | 2/2001 | Baker | H04R 1/005 327/99 |
| 6,223,546 | B1 * | 5/2001 | Chopko | B60H 1/3232 62/243 |
| 2002/0106091 | A1 * | 8/2002 | Furst | H04R 19/04 381/91 |
| 2012/0029837 | A1 * | 2/2012 | Katoh | B60K 35/00 702/33 |
| 2013/0048416 | A1 * | 2/2013 | Pradhan | F01N 1/023 181/268 |
| 2016/0344433 | A1 * | 11/2016 | Hsu | H04B 1/1081 |
| 2016/0372106 | A1 * | 12/2016 | Hanazono | F24F 13/24 |

* cited by examiner

WASTE AIR EXHAUSTING DEVICE HAVING FUNCTIONALITY TO ABATE NOISE AND MODULATE NOISE FREQUENCY

BACKGROUND OF THE INVENTION

1. Field of the Invention

The present invention relates to the technology field of exhaust mufflers, and more particularly to a waste air exhausting device having functionality to abate noise and modulate noise frequency.

2. Description of the Prior Art

Because a high-level noise would be produced during an engine of a motor or a motorcycle directly exhausting a waste air, it is necessary to treat the water air with a noise reducing process by using an exhaust silencer connected to exhaust port of the engine before the waster air is exhausted into air.

Please refer to FIG. 1, which illustrates a cross sectional view of a conventional exhaust silencer. As FIG. 1 shows, the conventional exhaust silencer 1' is constituted by a housing 10', an air inlet pipe 2', a communication pipe 3', an air outlet pipe 4', and a helical rod 5', wherein the inlet pipe 2' has a first air inlet 21' extending out of one end of the housing 10' for connecting with engine's exhaust port, and the air outlet pipe 4' has an exhaust outlet 42' extending out of the other end of the housing 10'. In addition, a first expansion chamber 11' is formed in the housing 10' for simultaneously communicating a first air outlet 22' of the inlet pipe 2' and a second air inlet 31' of the communication pipe 3'. Besides the first expansion chamber 11', a second expansion chamber 12' is also formed in the housing 10' or simultaneously communicating a second air outlet 32' of the communication pipe 3' and a third air inlet 41' of the air outlet pipe 4'. Moreover, a third expansion chamber 13' is formed in the housing 10' and disposed between the first expansion chamber 11' and the second expansion chamber 12'.

As FIG. 1 shows, in order to enhance the noise reduction efficiency of the exhaust silencer 1', a sound-absorbing material 30' is particularly adopted to cover a plurality of first perforations 24' formed on the side wall of the inlet pipe 2' and a plurality of second perforations 34' formed on the side wall of the communication pipe 3'. By such arrangements, the waste air would flow into the first expansion chamber 11' of the housing 10' for being treated with a first decompressional expansion process after being outputted by the engine and continuously flowing into the inlet pipe 2'. Furthermore, the waster air subsequently flows into the second expansion chamber 12' via the communication pipe 3' so as to be treated with a second decompressional expansion process; meanwhile, parts of waste air in the inlet pipe 2' and the communication pipe 3' would flow into the third expansion chamber by passing through the first perforations 24' and the second perforations 34', so as to be treated with a mixed decompression process. Eventually, after a noise muffling treatment is completed by the sound-absorbing material 30' to the waste air, the waste air is then converted to a vortex air flow by the hollow helical rod 5' and a plurality third perforations 511' formed on multi helical blades 51' of the helical rod 5'.

Although current motors or motorcycles have conventionally equipped with the exhaust silencer 1' shown in FIG. 1 for noise reduction, inventors of the present invention still find the conventional exhaust silencer 1' showing drawbacks and shortcomings in practical applications, wherein the drawbacks and shortcomings are listed as follows:

(1) The exhaust silencer 1' mainly utilizes discontinuous section areas (i.e., the perforations 24', 34' and 511') and the sound-absorbing material 30' to abate and muffle noise, so that the noise abatement efficiency of the exhaust silencer 1' is up to 6 dB. However, the noise abatement technology applied in the exhaust silencer 1' may cause engine's exhaust backpressure increase, such that the horsepower and the fuel consumption of the engine are hence decreased and increased, respectively.

(2) Moreover, engineers skilled in the noise-cancelling technology fields have known that the noise abatement technology applied in the exhaust silencer 1' is called passive noise reducing method, and the method can merely carry out a good noise reduction efficacy on those noises with frequencies over 500 Hz. However, most of frequencies carried by the noises produced during the engines of motors or motorcycles exhausting waste air are lower than 500 Hz, that means the said passive noise reducing method cannot effectively abate and muffle the noise produced by motor's or motorcycle's engine.

(3) The most important is that, because the exhaust silencer 1' is constituted by a housing 10', an air inlet pipe 2', a communication pipe 3', an air outlet pipe 4', a helical rod 5', and multi sound-absorbing materials 30', the exhaust silencer 1' includes some natural drawbacks such as heavy weight, large volume and hard to be assembled.

Accordingly, in view of the conventional exhaust silencer 1' showing many drawbacks and shortcomings in practical applications, the inventors of the present application have made great efforts to make inventive research thereon and eventually provided a waste air exhausting device having functionality to abate noise and modulate noise frequency.

SUMMARY OF THE INVENTION

The primary objective of the present invention is to provide a waste air exhausting device having functionality to abate noise and modulate noise frequency. Differing from conventionally-used exhaust pipe utilizing discontinuous section area(s) and sound-absorbing material(s) to reduce or cancel the noise produced by an engine, the present invention particularly provides a waste air exhausting device consisting of: a housing, a supporting plate disposed in the housing, a miniature microphone disposed at the end of the housing, and a loudspeaker disposed on the supporting plate. Therefore, according to the noise produced by the engine, a noise controller system coupling to the miniature microphone and the loudspeaker is able to produce an anti-noise signal through the loudspeaker for abating the engine noise. On the other hand, the noise controller system can also produce an anti-noise signal having specific frequencies components according to the frequency of the engine noise and a reference signal, so as to modulate the frequency of the engine noise by broadcasting the anti-noise signal having the specific frequencies components in the housing through the loudspeaker.

In order to achieve the primary objective of the present invention, the inventor of the present invention provides an embodiment for the waste air exhausting device having functionality to abate noise and modulate noise frequency, comprising:

a housing, being provided with a first opening and a second opening on two ends thereof;

a supporting plate, being disposed in the housing and having at least one installing hole and one through hole thereon;

an air exhausting pipe, being disposed in the housing by passing through the through hole of the supporting plate;

wherein the air exhausting pipe has an air inlet end and an air outlet end respectively extending out of the housing via the first opening and the second opening, and the air inlet end of the air exhausting pipe being used for connecting to an exhaust port of an external engine;

at least one loudspeaker, being connected to the installing hole;

a noise sensing module, being disposed near to the exhaust port of the external engine for receiving an engine speed signal of the external engine or a noise signal produced during the external engine outputting a waste air by the exhaust port;

an error signal sensing module, being disposed in the housing and adjacent to the air outlet end of the air exhausting pipe and the least one loudspeaker; and a noise controller, comprising:

a first input end, being connected to the noise sensing module;

an output end, being electrically connected to the loudspeaker; and a second input end, being electrically connected to the error signal sensing module;

wherein the noise controller is able to produce an analog anti-noise signal according to the noise signal, and the analog anti-noise signal being then broadcasted by the loudspeaker for reducing the noise level of the noise signal;

wherein the error signal sensing module subsequently collects a remaining noise signal after a noise reduction is carried out between the analog anti-noise signal and the noise signal, and then transmits the remaining noise signal to the noise controller, such that the noise controller applies an adaptive modulation to the analog anti-noise signal according to the remaining noise signal;

wherein noise controller is able to output an analog noise-modulating signal according to a reference signal and the engine speed signal, and broadcasting the analog noise-modulating signal by the loudspeaker, so as to modulate the noise signal to the reference signal.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a waste air exhausting device having functionality to abate noise and modulate noise frequency according to the present invention, embodiments of the present invention will be described in detail with reference to the attached drawings hereinafter.

First Embodiment

Figure 1:
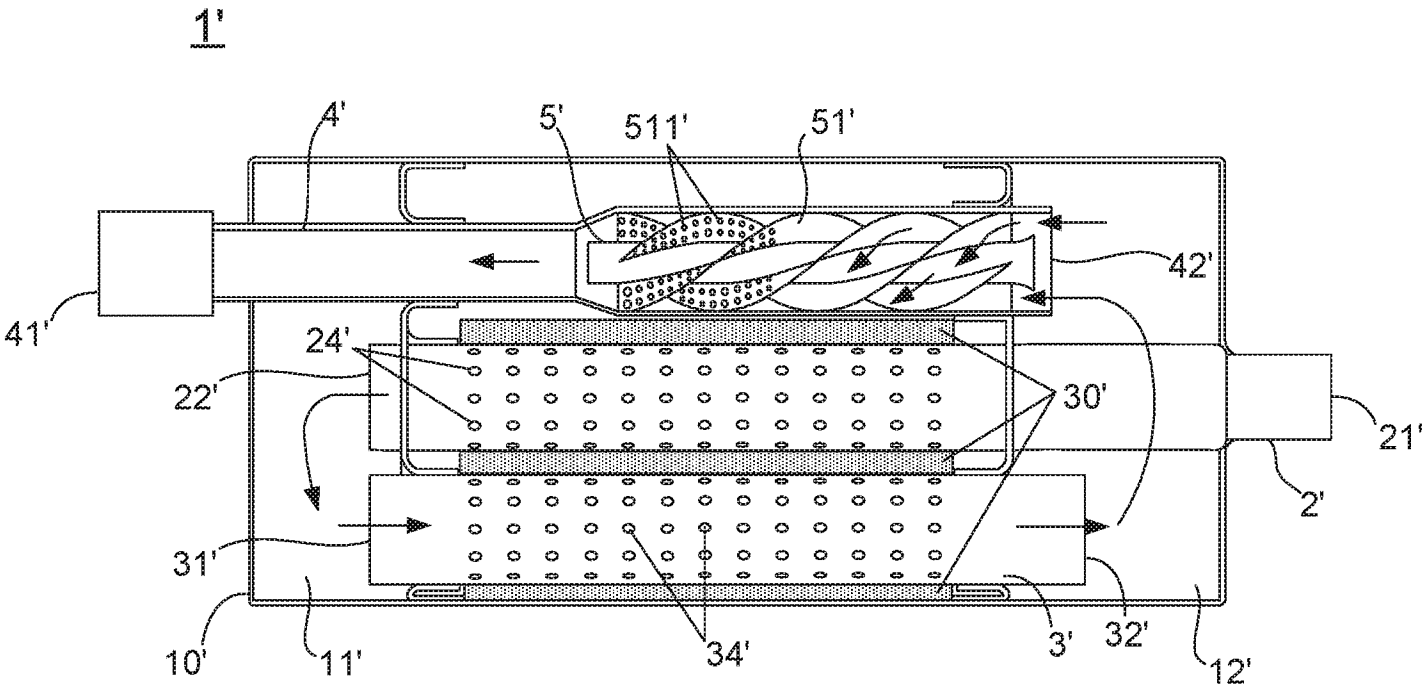
FIG 1 (Prior Art)
FIG. 1 shows a cross sectional view of a conventional exhaust silencer.
Figure 2:
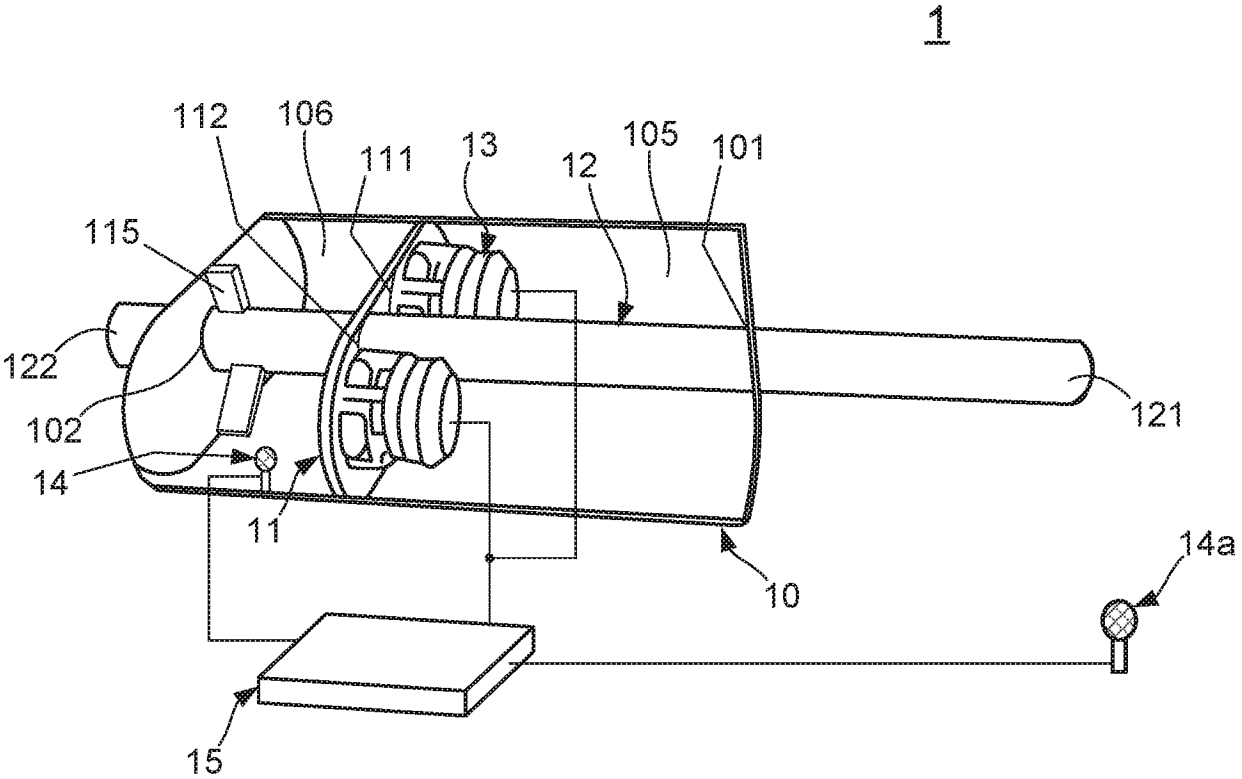
FIG. 2 shows a perspective stereo diagram of a first embodiment of a waste air exhausting device having functionality to abate noise and modulate noise frequency according to the present invention.

With reference to FIG. 2, where provides a perspective stereo diagram of a first embodiment of a waste air exhausting device having functionality to abate noise and modulate noise frequency according to the present invention. Moreover, please simultaneously refer to a schematic framework view of the first embodiment of the waste air exhausting device shown in FIG. 3. From FIG. 2 and FIG. 3, it can find that the waste air exhausting device 1 proposed by the present invention consists of: a housing 10, a supporting plate 11, an air exhausting pipe 12, at least one loudspeaker 13, a noise sensing module, an error signal sensing module 14, and a noise controller 15. In the first embodiment of the waste air exhausting device 1, the housing 10 is made of stainless steel material, and provided with a first opening 101 and a second opening 102 on two ends thereof. It is worth explaining that, appearance and size of the housing 10 can be particularly designed according to different motors or motorcycles; for example, the appearance and size of the housing 10 can be designed to be the same as the housing's (10') shown in FIG. 1.

Inheriting to above descriptions, the supporting plate 11 is disposed in the housing 10 for separating the housing 10 to a first space 105 and a second space 106; wherein the first space 105 and the second space 106 have a specific length ratio. Moreover, the supporting plate 11 has one through hole 112 and at least one installing hole 111 for the installation of the loudspeaker 13. On the other hand, the air exhausting pipe 12 is disposed in the housing 10 by passing through the through hole 112 of the supporting plate 11, and an air inlet end 121 and an air outlet end 122 of the air exhausting pipe 12 are respectively extended out of the housing 10 via the first opening 101 and the second opening 102. From FIG. 3, it can further find that the air inlet end 121 of the air exhausting pipe 12 is designed for connecting to an exhaust port M1 of an external engine M; moreover, a plurality of supporting ribs 115 are formed and locate around the first opening 101 and the second opening 102 for supporting the air exhausting pipe 12.

In the first embodiment of the waste air exhausting device 1, the noise sensing module comprises at least one miniature microphone 14*a*, which is disposed near to the exhaust port M1 of the external engine M for receiving a noise signal produced during the external engine M exhausting a waste air. Moreover, the error signal sensing module 14, an error microphone, is disposed in the housing 10 and adjacent to the air outlet end 122 of the air exhausting pipe 12.

Figure 3:
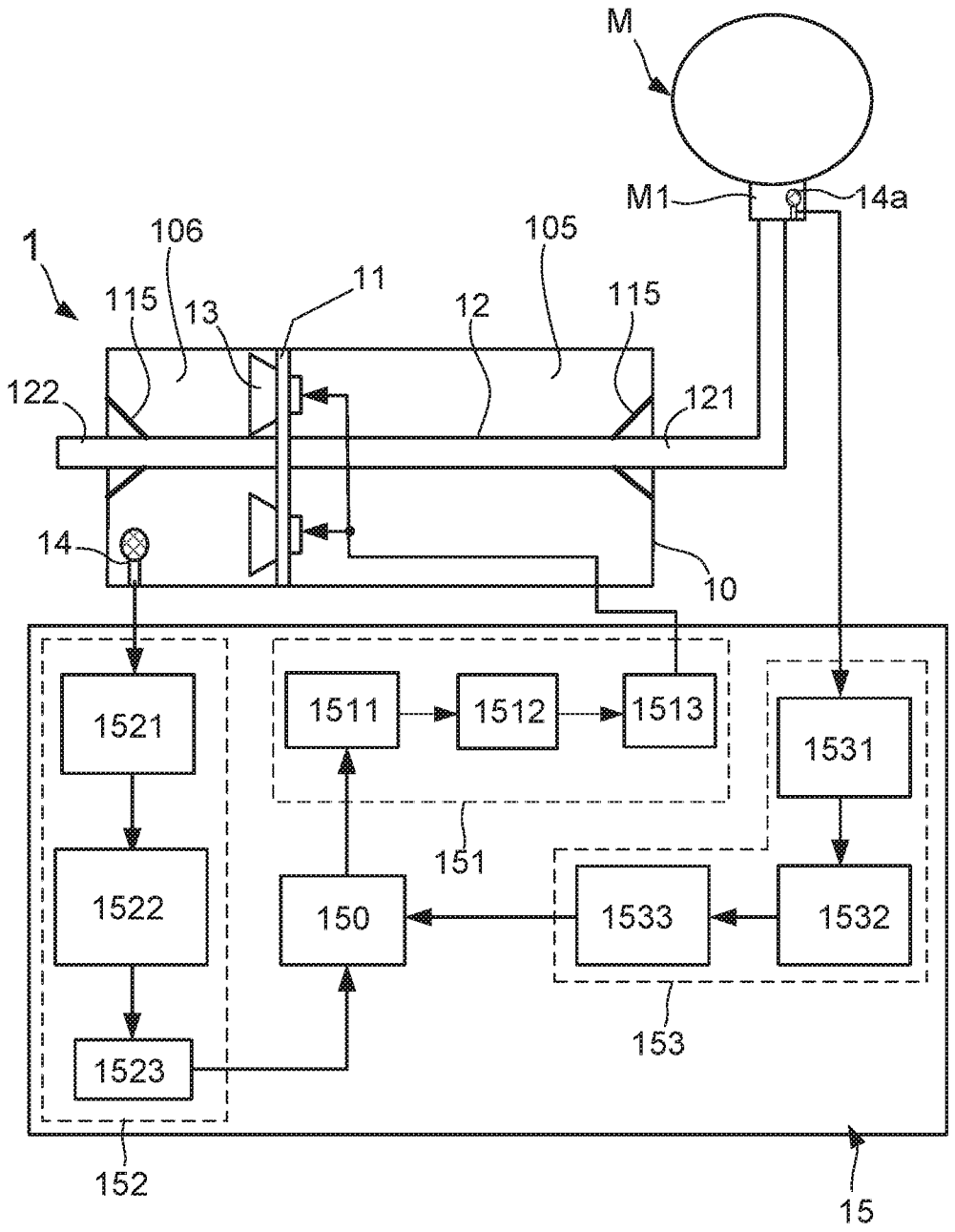
FIG. 3 shows a schematic framework view of the first embodiment of the waste air exhausting device.

It is worth explaining that, an active noise controlling (ANC) technology is applied in the first embodiment of the waste air exhausting device 1 for effectively cancelling the noise produced by the engine M. So that, engineers skilled in ANC technology field can easily know that the noise controller 15 shown in FIG. 2 and FIG. 3 is a digital signal processor. However, that is not used for limiting the embodiment of the noise controller 15. In other practicable applications, field programmable gate array (FPGA) chip or ARM processor can be used as the noise controller 15. As FIG. 3 shows, the circuit framework of the noise controller 15 consists of: a main processor 150, a digital-to-analog processing module 151, a first analog-to-digital processing module 153, and a second analog-to-digital processing module 152, wherein the main processor 150 is able to receive the noise signal from a first input end of the noise controller 15, and then correspondingly produce a digital anti-noise signal.

After receiving the digital anti-noise signal, the digital-to-analog processing module 151 is able to convert the digital anti-noise signal an analog anti-noise signal; and then, the analog anti-noise signal is outputted to the loudspeaker 13 via an output end of the noise controller 15. Eventually, the loudspeaker 13 broadcasts an anti-noise signal to the second space 106 of the housing 10 for reducing the noise level of the noise signal carried by the water air flowing in the air exhausting pipe 12. As FIG. 3 shows, the digital-to-analog processing module 151 consists of a digital-to-analog converting unit 1511, a reconstruction filter 1512 and an amplifier 1513, wherein the digital-to-analog converting unit 1511 is used for respectively converting the digital anti-noise signal to the said analog anti-noise signal. In the first embodiment of the waste air exhausting device 1, the reconstruction filter 1512 is adopted for treating the analog anti-noise signal and the analog noise-modulating signal with a reconstruction process, and the amplifier 1513 is used for amplifying the analog anti-noise signal and the analog noise-modulating signal.

The first analog-to-digital processing module 153 is coupled to the main processor 150 and the noise sensing module, used for converting the noise signal transmitted from the noise sensing module to a digital noise signal. As FIG. 3 shows, the first analog-to-digital processing module 153 consists of a first pre-amplifier 1531 for pre-amplifying the noise signal, a first antialiasing filter 1532 for filtering high-frequency noises carried by the noise signal, and a first analog-to-digital converting unit 1533 for converting the noise signal to the digital noise signal.

The second analog-to-digital processing module 152 is coupled to the main processor 150 and the error signal sensing module 14, used for converting the remaining noise signal transmitted from the error signal sensing module 14 to a digital remaining noise signal. Herein, it needs to further explain that, the said remaining noise signal produced after the anti-noise signal abates the noise signal. As FIG. 3 shows, the second analog-to-digital processing module 152 consists of a second pre-amplifier 1521 for pre-amplifying the remaining noise signal, a second antialiasing filter 1522 for filtering high-frequency noises carried by the remaining noise signal, and a second analog-to-digital converting unit 1523 for converting the remaining noise signal to the digital remaining noise signal.

Figure 4:
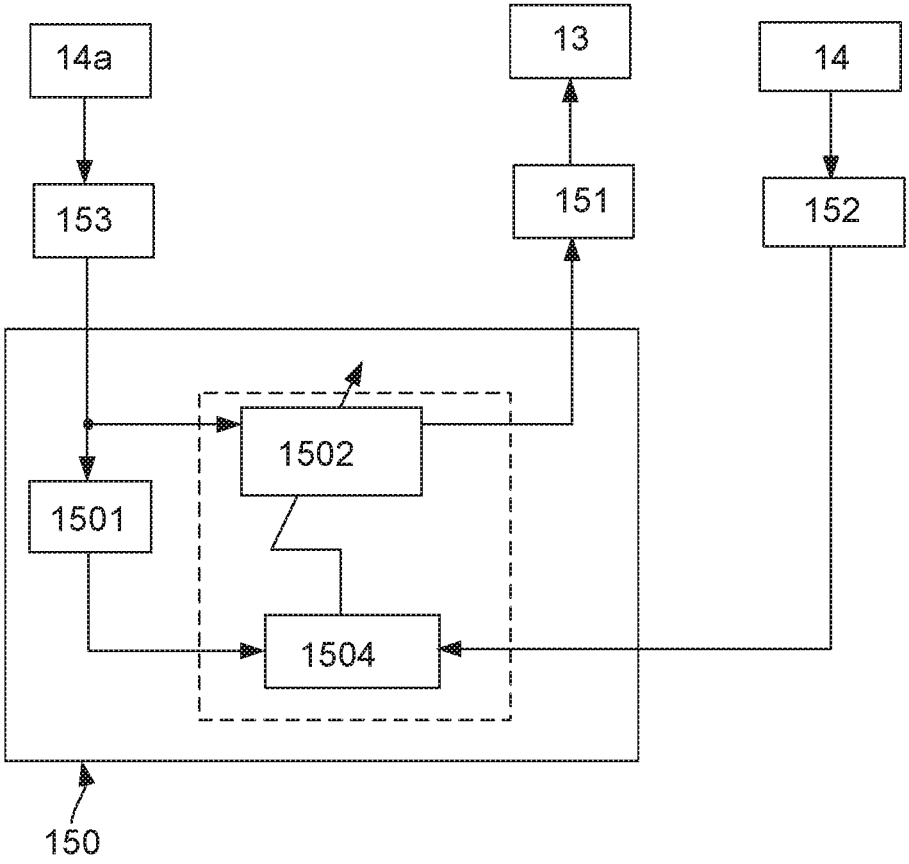
FIG. 4 shows a first schematic internal framework view of a main processor of the waste air exhausting device.

Continuously referring to FIG. 2 and FIG. 3, and please simultaneously refer to a first schematic internal framework view of the main processor provided by FIG. 4. In the first embodiment of the waste air exhausting device 1, the main processor 150 is able to receive the digital noise signal outputted by the first analog-to-digital processing module 153 and then output a digital anti-noise signal to the digital-to-analog processing module 151. Subsequently, the digital-to-analog processing module 151 converts the digital anti-noise signal to an analog anti-noise signal. In an ideal situation, an excellent noise reduction can be carried out when a phase difference between the analog anti-noise signal broadcasted by the loudspeaker 13 and the noise signal is equal to 180 degree.

It is worth noting that, during the execution of the active noise controlling (ANC) method applied in this waste air exhausting device 1, the digital anti-noise signal outputted by the main processor 150 is eventually converted to the analog anti-noise signal after related signal processes are completed by the digital-to-analog converting unit 1511, the reconstruction filter 1512 and the amplifier 1513. Similarly, the remaining noise signal collected by the error signal sensing module 14 is eventually converted to the digital remaining noise signal after related signal processes are completed by the second pre-amplifier 1521, the second antialiasing filter 1522 and the second analog-to-digital converting unit 1523.

Moreover, as shown in FIG. 4, the anti-noise signal is then broadcasted into the second space 106 after the main processor 150 outputs a white noise or other anti-noise signal to the digital-to-analog processing module 151. In addition, after receiving the remaining noise signal, the error signal sensing module 14 transmits the remaining noise signal to the second analog-to-digital processing module 152 for being converted to the said digital remaining noise signal, and then the digital remaining noise signal is subsequently transmitted to the main processor 150. It is worth explaining that, the frequency response existing in the signal transmission path between the first analog-to-digital processing module 153 and the main processor 150 is call secondary path response, which is presented as S(z) mathematically. In the present invention, a first transfer function estimating unit 1501, being mathematically presented as S(z), is particularly added in the main processor 150 for estimating influences caused by the frequency response.

As FIG. 4 shows, the main processor 150 consists of a first transfer function estimating unit 1501, an adaptive filter 1502 and an adaptive algorithm unit 1504, wherein the first transfer function estimating unit 1501 is coupled to the first analog-to-digital converting unit 1533 for filtering the digital noise signal, so as to output a filtered noise signal. In addition, the adaptive filter 1502 is connected to the first analog-to-digital converting unit 1533 of the first analog-to-digital processing module 153 for receiving the digital noise signal, and then after treating the digital noise signal with an impulse response filtering process.

Inhering to above descriptions, the adaptive algorithm unit 1504 is connected to the adaptive filter 1502, and configured to receive the digital remaining noise signal outputted by the second analog-to-digital processing module 152 and the filtered noise signal outputted by the first transfer function estimating unit 1501, so as to calculate a modulation weight for the adaptive filter, such that the adaptive filter outputs a modulated digital anti-noise signal according to the modulation weight. Therefore, according to the modulation weight, the adaptive filter 1502 is able to correspondingly output a modulated digital noise-modulating signal to the digital-to-analog processing module 151.

Because the present invention does not limit the adaptive filter 1502 as one specific type of filters, the adaptive filter 1502 can be a finite impulse response (FIR) filter, an infinite impulse response filter (IIR) filter, or any one kind of filters. Moreover, the adaptive algorithm unit comprises a specific algorithm, such as least mean square (LMS) algorithm, normalized least mean square (NLMS) algorithm, or others algorithm. It is worth explaining that, since the main processor 150 includes the first transfer function estimating unit 1501, the LMS algorithm is further called filtered-x LMS algorithm when being used in the adaptive algorithm unit.

Second Embodiment

Figure 5:
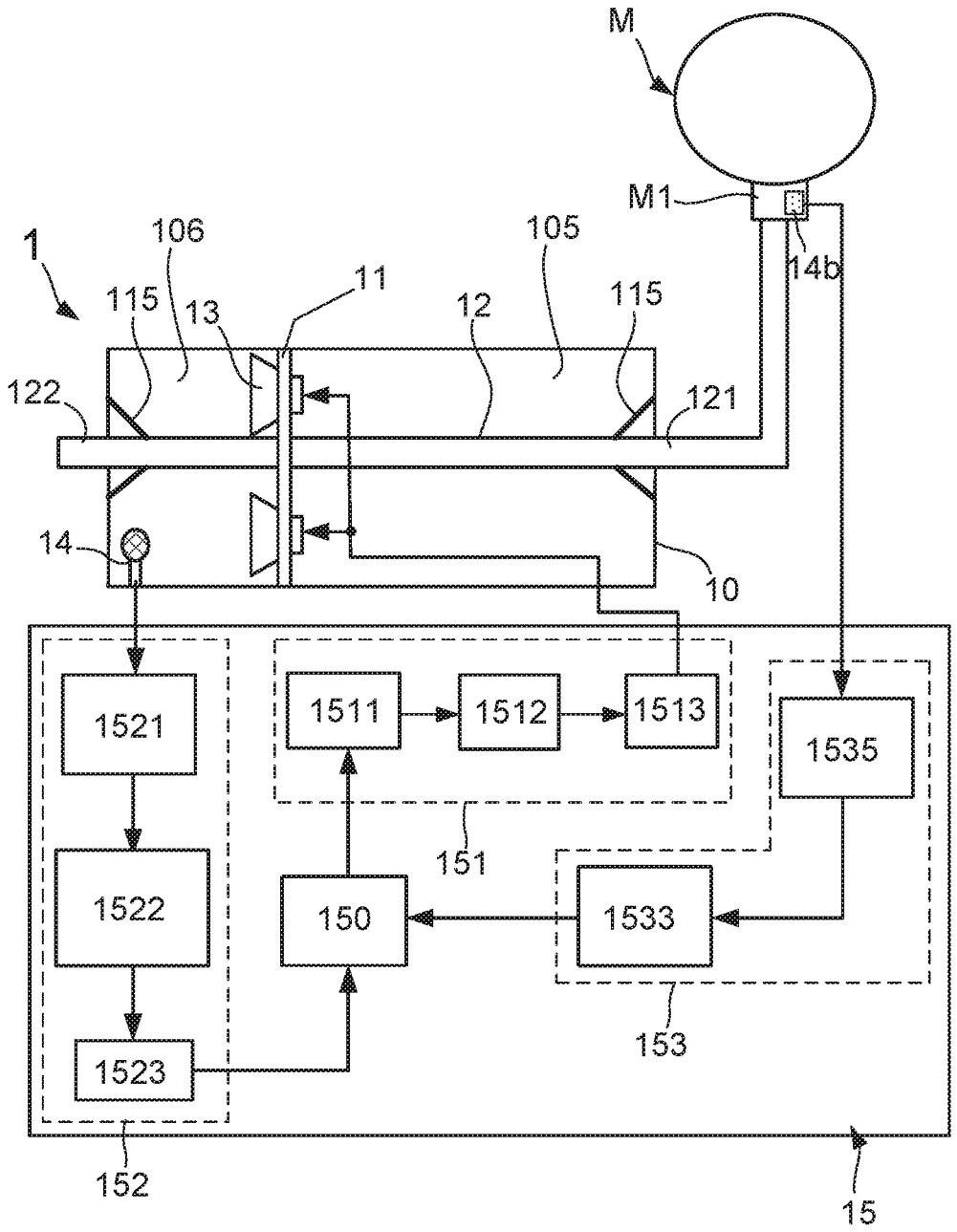
FIG. 5 shows a schematic framework view of a second embodiment of the waste air exhausting device having functionality to abate noise and modulate noise frequency according to the present invention.

Please refer to FIG. 5, where a schematic framework view of a second embodiment of the waste air exhausting device proposed by the present invention is provided. As FIG. 5 shows, the second embodiment of the waste air exhausting device 1 mainly comprises: a housing 10, a supporting plate 11, an air exhausting pipe 12, at least one loudspeaker 13, a noise sensing module, an error signal sensing module 14, and a noise controller 15. Moreover, from the second schematic internal framework view of the main processor shown in FIG. 6, it can find that the said noise sensing module is a tachometer for sensing an engine speed signal of the engine M.

In the second embodiment, the first analog-to-digital processing module 153 comprises a synchronous signal generator 1535, used for receiving the engine speed signal and then synchronously produce multi analog noise signal according to the engine speed signal. For example, after the synchronous signal generator 1535 finds that the engine speed signal carries a plurality of noise signal including $f_1$, $f_2$, . . . , and $f_k$, the synchronous signal generator 1535 is able to produce multi analog noise signal correspondingly. Moreover, the first analog-to-digital processing module 153 further comprises a first analog-to-digital processing unit, which is coupled to the synchronous signal generator 1535 for receiving and converting the multi analog noise signal to multi digital noise signal.

Figure 6:
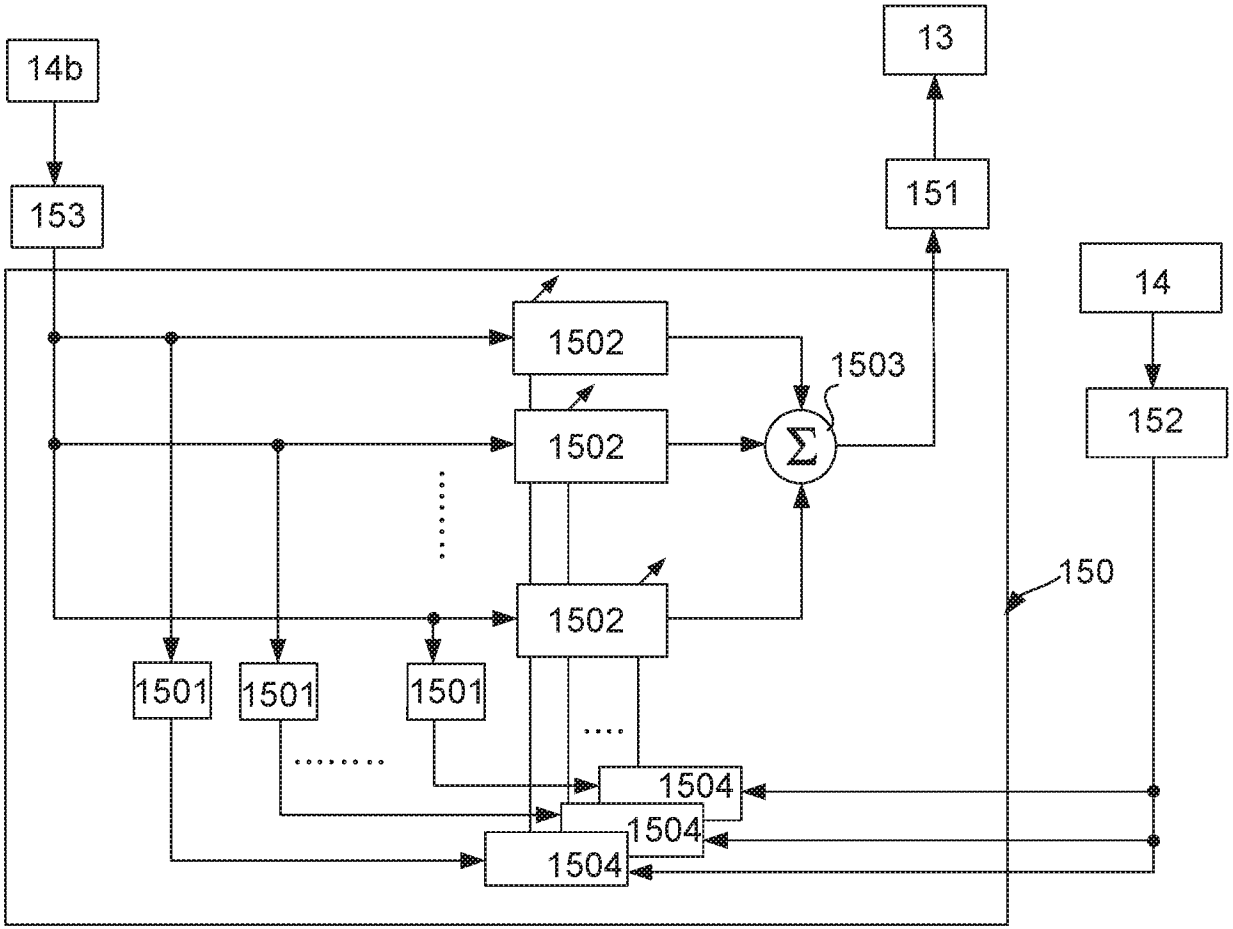
FIG. 6 shows a second schematic internal framework view of the main processor of the waste air exhausting device.

As shown in FIG. 5 and FIG. 6, a plurality of first transfer function estimating units 1501, a plurality of adaptive filters 1502, a plurality of adaptive algorithm units 1504, and an adder 1503 are arranged in the main processor 150 for simultaneously processing multi digital noise signal. In the main processor 150, the first transfer function estimating units 1501 are coupled to the first analog-to-digital processing module 153 for filtering the multi digital noise signal, so as to correspondingly output multi filtered noise signal. Moreover, the adaptive filters 1502 are also coupled to the first analog-to-digital processing module 153 for receiving the multi digital noise signal. After treating the multi digital noise signal with an impulse response filtering process, the adaptive filters 1502 does therefore output multi digital anti-noise signal correspondingly.

Inheriting to above descriptions, the adaptive algorithm units 1504 are connected to the adaptive filters 152; wherein the adaptive algorithm units 1504 are able to receive the digital remaining noise signal outputted by the second analog-to-digital processing module 152 and the filtered noise signal outputted by the first transfer function estimating unit 1501, so as to calculate a modulation weight for the adaptive filters 1502. Therefore, the adaptive filters 1502 are able to correspondingly output a plurality of modulated digital noise-modulating signal based on the modulation weight. In addition, the adder 1503 coupled to the adaptive filters 1502 is used for mixing the multi digital anti-noise signal or the modulated digital noise-modulating signal to one single digital anti-noise signal, so as to output the said digital anti-noise signal to the digital-to-analog processing module 151.

Figure 7:
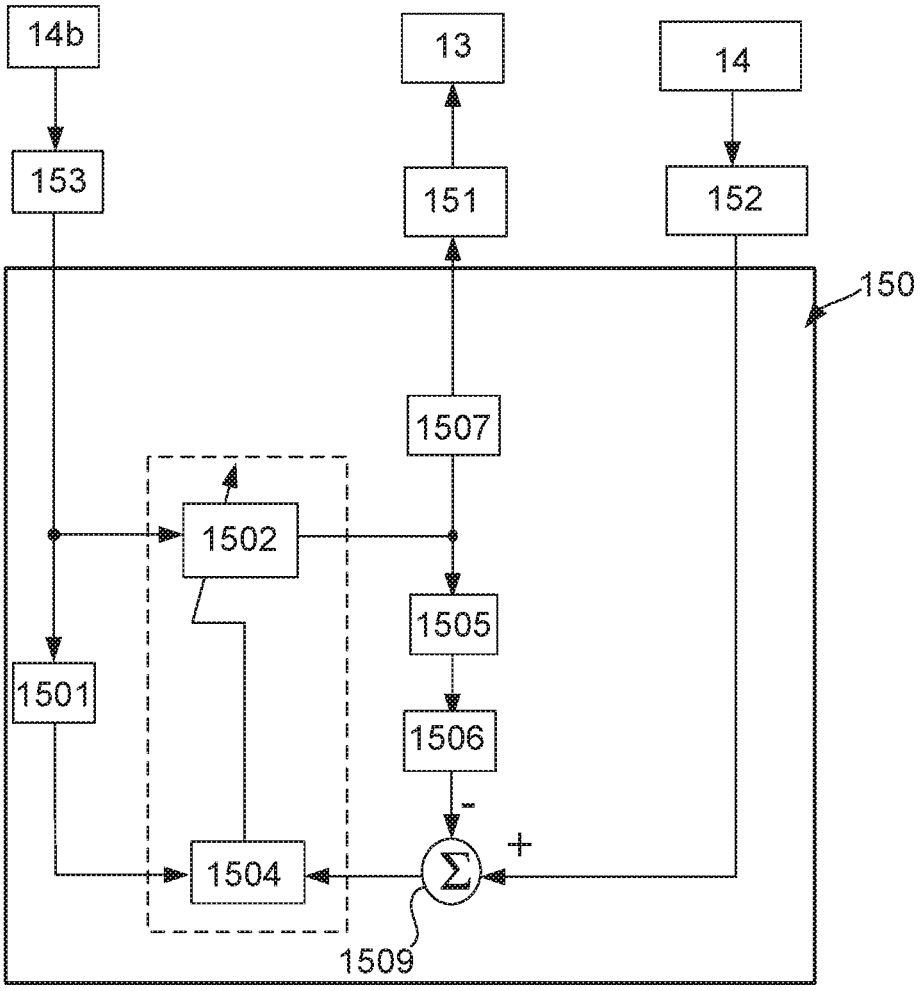
FIG. 7 shows of the waste air exhausting device a third schematic internal framework view of the main processor.

Continuously referring to FIG. 5, and please simultaneously refer to a third schematic internal framework view of the main processor shown in FIG. 7. In the second embodiment of the present invention, the noise controller 15 is able to output an analog noise-modulating signal according to a reference signal and the engine speed signal, and then broadcast the analog noise-modulating signal by the loudspeaker, so as to modulate the noise signal to the reference signal. The said reference signal is set by user (driver); for instance, the reference signal can be a BMW noise signal produced during a BMW motor's engine exhausting water air. That is, if a TOYOTA motor is equipped with this novel waste air exhausting device 1, a TOYOTA noise signal produced during the TOYOTA motor's engine exhausting water air can be converted to the BMW noise signal after the user sets the reference signal as the BMW noise signal.

In order to achieve aforesaid noise signal conversion function, the main processor 150 is additionally disposed with a plurality of circuit units, including: a first error compensating unit 1505 connected to the adaptive filter 1502, a second transfer function estimating unit 1506 connected to the first error compensating unit 1505, an error compensating unit 1507, and a subtractor 1509; wherein the second transfer function estimating unit 1506 is connected between the adaptive filter 1502 and the digital-to-analog processing module 151. Moreover, the subtractor 1509 is connected between adaptive algorithm unit 1504 and the second analog-to-digital processing module 152. By such circuit arrangements, the main processor can perform the said noise signal conversion function by way of modulating an i-th frequency carried by the noise signal of the TOYOTA motor's engine. It needs to further explain that the noise signal of motor's engine often carries with a plurality of noise frequencies, including: $f_1$, $f_2$, . . . , and $f_k$.

As FIG. 7 shows, the first error compensating unit 1505 is coupled to the adaptive filter 1502, respectively; wherein the first error compensating unit is used for multiplying the digital anti-noise signal by a first amplitude error ratio ($\beta$). In addition, the second transfer function estimating unit 1506, being coupled to the first error compensating unit 1505, is used for filtering the digital anti-noise signal and then outputting a filtered digital anti-noise signal. Moreover, the second error compensating unit 1507 is used for multiplying the digital anti-noise signal by a second amplitude error ratio ($1-\beta$), wherein the summation of the first amplitude error ratio and the second amplitude error ratio is 1.

Inheriting to above descriptions, the subtractor 1509 is connected to the second transfer function estimating unit 1506, the second analog-to-digital processing module 152 and the adaptive algorithm unit 1504, and arranged for receiving the filtered digital anti-noise signal outputted by the second transfer function estimating unit 1506 and the digital remaining noise signal outputted by the second analog-to-digital processing module 152, so as to correspondingly output an error signal to the adaptive algorithm unit 1504. Thus, after receiving the filtered digital anti-noise signal outputted by the second transfer function estimating unit 1506 and the error signal outputted by the subtractor 1509, the adaptive algorithm unit 1504 is able to calculate a modulation weight for the adaptive filter 1502. Therefore, according to the reference signal (set by user or driver), the digital noise signal and the modulation weight, the adaptive filter 1502 is able to correspondingly output a modulated digital noise-modulating signal to the digital-to-analog processing module 151.

Moreover, from FIG. 6 and FIG. 7, the person skilled in noise cancelling technology field is able to know that, multi first error compensating units 1505, second transfer function estimating units 1506, error compensating units 1507, and subtractors 1509 must simultaneously arranged in the circuit framework of the main processor 150 when the main processor 150 is adopted to carry out noise reduction treatments on the noise signal carries with a plurality of noise frequencies (including: $f_1$, $f_2$, . . . , and $f_k$).

Therefore, through above descriptions, the waste air exhausting device having functionality to abate noise and modulate noise frequency provided by the present invention has been introduced completely and clearly; in summary, the present invention includes the advantages of:

(1) Differing from conventionally-used exhaust silencer 1' (shown in FIG. 1) utilizing discontinuous section area(s) and sound-absorbing material(s) to abate the noise produced by an engine, the present invention provides a waste air exhausting device 1 consisting of: a housing 10, a supporting plate 11 disposed in the housing 10, a miniature microphone 14*a* disposed at the end of the housing 10, and a loudspeaker 13 disposed on the supporting plate 11. Therefore, according to the noise produced by the engine M, a noise controller 15 system coupling to the miniature microphone 14*a* and the loudspeaker 13 is able to produce an anti-noise signal through the loudspeaker 13 for abating the engine noise.

(2) Moreover, because the waste air exhausting device 1 of the present invention is applied with an active noise controlling (ANC) technology for effectively cancelling the noise produced by the engine M, the exhaust backpressure of the engine M connected with the novel waste air exhausting device 1 would not be increased.

(3) On the other hand, the noise controller 15 of the waste air exhausting device 1 can also produce an anti-noise signal having specific frequency components according to the engine's noise signal and a user-set reference signal, so as to modulate the frequency of the engine's noise signal by broadcasting the anti-noise signal having the specific frequencies components in the housing 10 through the loudspeaker 13.

The above description is made on embodiments of the present invention. However, the embodiments are not intended to limit scope of the present invention, and all equivalent implementations or alterations within the spirit of the present invention still fall within the scope of the present invention.

What is claimed is:

1. A waste air exhausting device having functionality to abate noise and modulate noise frequency, comprising:

a housing, being provided with a first opening and a second opening on two ends thereof;

a supporting plate, being disposed in the housing for forming a first space and a second space in the housing 10, and having at least one installing hole and one through hole thereon;

an air exhausting pipe, being disposed in the housing by passing through the through hole of the supporting plate; wherein the air exhausting pipe has an air inlet end and an air outlet end respectively extending out of the housing via the first opening and the second opening, and the air inlet end of the air exhausting pipe being used for connecting to an exhaust port of an external engine;

at least one loudspeaker, being disposed in the second space by connecting to the installing hole, so as to face the second opening of the housing;

a noise sensing module, being disposed near to the exhaust port of the external engine for receiving an engine speed signal of the external engine or a noise signal produced during the external engine outputting a waste air by the exhaust port;

an error signal sensing module, being disposed in the second space of the housing and adjacent to the air outlet end of the air exhausting pipe so as to face the least one loudspeaker; and a noise controller, comprising:

a first input end, being connected to the noise sensing module;

an output end, being electrically connected to the loudspeaker; and a second input end, being electrically connected to the error signal sensing module;

wherein the noise controller is configured to produce an analog anti-noise signal according to the noise signal, and the analog anti-noise signal being then broadcasted in the second space of the housing by the loudspeaker for reducing, so as to reduce the noise level of the noise signal;

wherein the error signal sensing module subsequently collects a remaining noise signal after a noise reduction is carried out between the analog anti-noise signal and the noise signal, and then transmits the remaining noise signal to the noise controller, such that the noise controller applies an adaptive modulation to the analog anti-noise signal according to the remaining noise signal;

wherein noise controller is able to output an analog noise-modulating signal according to a reference signal and the engine speed signal, and broadcasting the analog noise-modulating signal by the loudspeaker, so as to modulate the noise signal to the reference signal.

2. The waste air exhausting device of claim 1, further comprising a plurality of supporting ribs, being formed in the housing and locating around the first opening and the second opening, used for supporting the air exhausting pipe.

3. The waste air exhausting device of claim 1, wherein the housing is made of stainless steel material.

4. The waste air exhausting device of claim 1, wherein the noise sensing module comprises a miniature microphone and a tachometer.

5. The waste air exhausting device of claim 1, wherein the error signal sensing module is an error microphone.

6. The waste air exhausting device of claim 1, wherein the noise controller is selected from the group consisting of: digital signal processor and microprocessor.

7. The waste air exhausting device of claim 1, wherein the analog anti-noise signal and the noise signal have a phase difference of 180 degree.

8. The waste air exhausting device of claim 1, wherein the noise controller further comprises:

a main processor, being able to receive the noise signal or the engine speed signal from the first input end, and then correspondingly produce a digital anti-noise signal or a digital noise-modulating signal;

a digital-to-analog processing module, being coupled to the main processor for receiving the digital anti-noise signal or the digital noise-modulating signal, so as to convert the digital anti-noise signal and the digital noise-modulating signal to the said analog anti-noise signal and the said analog noise-modulating signal, respectively;

a first analog-to-digital processing module, being coupled to the main processor and the noise sensing module, used for converting the noise signal or the engine speed signal transmitted from the noise sensing module to a digital noise signal; and a second analog-to-digital processing module, being coupled to the main processor and the error signal sensing module, used for converting the remaining noise signal transmitted from the error signal sensing module to a digital remaining noise signal.

9. The waste air exhausting device of claim 8, wherein the first analog-to-digital module comprises:

a first pre-amplifier for pre-amplifying the noise signal;

a first antialiasing filter for filtering high-frequency noises carried by the noise signal; and a first analog-to-digital converting unit for converting the noise signal to the digital noise signal.

10. The waste air exhausting device of claim 9, wherein the main processor comprises:

a first transfer function estimating unit, being coupled to the first analog-to-digital processing module for filtering the digital noise signal, so as to output a filtered noise signal;

an adaptive filter, being connected to the first analog-to-digital processing module for receiving the digital noise signal, and then treating the digital noise signal with an impulse response filtering process; and an adaptive algorithm unit, being connected to the adaptive filter; wherein the adaptive algorithm unit is able to receive the digital remaining noise signal outputted by the second analog-to-digital processing module and the filtered noise signal outputted by the first transfer function estimating unit, so as to calculate a modulation weight for the adaptive filter, such that the adaptive filter outputs a modulated digital anti-noise signal according to the modulation weight.

11. The waste air exhausting device of claim 10, wherein the adaptive algorithm unit comprises a specific algorithm selected from the group consisting of: least mean square (LMS) algorithm, normalized least mean square (NLMS) algorithm and others algorithm.

12. The waste air exhausting device of claim 9, wherein the second analog-to-digital processing module comprises:

a second pre-amplifier for pre-amplifying the remaining noise signal;

a second antialiasing filter for filtering high-frequency noises carried by the remaining noise signal; and a second analog-to-digital converting unit for converting the remaining noise signal to the digital remaining noise signal.

13. The waste air exhausting device of claim 9, wherein the digital-to-analog processing module comprises:

a digital-to-analog converting unit, being used for respectively converting the digital anti-noise signal and the digital noise-modulating signal to the analog anti-noise signal and the analog noise-modulating signal;

a reconstruction filter for treating the analog anti-noise signal and the analog noise-modulating signal with a reconstruction process; and an amplifier for amplifying the analog anti-noise signal and the analog noise-modulating signal.

14. The waste air exhausting device of claim 8, wherein the first analog-to-digital processing module comprises:

a synchronous signal generator, being used for receiving the engine speed signal, so as to synchronously produce multi analog noise signal according to the engine speed signal; and a first analog-to-digital processing unit, being coupled to the synchronous signal generator for converting the multi analog noise signal to multi digital noise signal.

15. The waste air exhausting device of claim 14, wherein the main processor comprises:

a plurality of first transfer function estimating units, being coupled to the first analog-to-digital processing module for filtering the multi digital noise signal, so as to correspondingly output multi filtered noise signal;

a plurality of adaptive filters, being connected to the first analog-to-digital processing module for receiving the multi digital noise signal, and then outputting correspondingly multi digital anti-noise signal after treating the multi digital noise signal with an impulse response filtering process;

a plurality of adaptive algorithm units, being connected to the adaptive filters; wherein the adaptive algorithm units are able to receive the digital remaining noise signal outputted by the second analog-to-digital processing module and the filtered noise signal outputted by the first transfer function estimating unit, so as to calculate a modulation weight for the adaptive filter; and an adder, being coupled to the adaptive filters; wherein the adder is used for mixing the multi digital anti-noise signal to one single digital anti-noise signal, and then outputting the digital anti-noise signal to the digital-to-analog processing module.

16. The waste air exhausting device of claim 15, wherein the adaptive filter is selected from the group consisting of: finite impulse response (FIR) filter, infinite impulse response filter (IIR) filter and others filter.

17. The waste air exhausting device of claim 15, wherein the adaptive algorithm unit comprises a specific algorithm selected from the group consisting of: least mean square (LMS) algorithm, normalized least mean square (NLMS) algorithm and others algorithm.

18. The waste air exhausting device of claim 15, wherein the main processor further comprises:

a plurality of first error compensating units, being coupled to the adaptive filters, respectively; wherein the first error compensating unit is used for multiplying the digital anti-noise signal by a first amplitude error ratio;

a plurality of second transfer function estimating units, being respectively coupled to the first error compensating units for filtering the digital anti-noise signal, so as to output a filtered digital anti-noise signal;

a plurality of second error compensating units, being coupled to the adaptive filters, respectively; wherein the second error compensating unit is used for multiplying the digital anti-noise signal by a second amplitude error ratio, and the summation of the first amplitude error ratio and the second amplitude error ratio is 1; and a plurality of subtractors, wherein each of the subtractors are connected with one second transfer function estimating unit, one adaptive algorithm unit, and the second analog-to-digital processing module, and used for receiving the filtered digital anti-noise signal outputted by the second transfer function estimating unit and the digital remaining noise signal outputted by the second analog-to-digital processing module, so as to correspondingly output an error signal to the adaptive algorithm unit;

wherein after receiving the filtered digital anti-noise signal outputted by the second transfer function estimating unit and the error signal outputted by the subtractor, the adaptive algorithm unit is able to calculate a modulation weight for the adaptive filter; therefore, according to the reference signal, the digital noise signal and the modulation weight, the adaptive filter correspondingly outputting a modulated digital noise-modulating signal to the digital-to-analog processing module.

19. The waste air exhausting device of claim 14, wherein the adaptive filter is selected from the group consisting of: finite impulse response (FIR) filter, infinite impulse response filter (IIR) filter and others filter.

20. The waste air exhausting device of claim 14, wherein the second analog-to-digital processing module comprises:

a second pre-amplifier for pre-amplifying the remaining noise signal;

a second antialiasing filter for filtering high-frequency noises carried by the remaining noise signal; and a second analog-to-digital converting unit for converting the remaining noise signal to the digital remaining noise signal.

21. The waste air exhausting device of claim 14, wherein the digital-to-analog processing module comprises:

a digital-to-analog converting unit, being used for respectively converting the digital anti-noise signal and the digital noise-modulating signal to the analog anti-noise signal and the analog noise-modulating signal;

a reconstruction filter for treating the analog anti-noise signal and the analog noise-modulating signal with a reconstruction process; and an amplifier for amplifying the analog anti-noise signal and the analog noise-modulating signal.

* * * * *